US007322763B2

(12) United States Patent
Yang

(10) Patent No.: US 7,322,763 B2
(45) Date of Patent: Jan. 29, 2008

(54) MEDIA CASSETTE FOR PRINTING APPARATUS

(75) Inventor: Yong-Sok Yang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 237 days.

(21) Appl. No.: 11/036,070

(22) Filed: Jan. 18, 2005

(65) Prior Publication Data

US 2005/0158111 A1 Jul. 21, 2005

(30) Foreign Application Priority Data

Jan. 20, 2004 (KR) ..... 10-2004-0004430
Apr. 8, 2004 (KR) ..... 10-2004-0024025
Aug. 16, 2004 (KR) ..... 10-2004-0064262

(51) Int. Cl.
*B41J 11/58* (2006.01)

(52) U.S. Cl. ..... 400/624; 399/393; 271/145

(58) Field of Classification Search ..... None
See application file for complete search history.

(56) References Cited

U.S. PATENT DOCUMENTS 4,698,646 A * 10/1987 Satoh et al. ..... 347/214
5,040,912 A 8/1991 Koizumi
5,053,814 A * 10/1991 Takano et al. ..... 399/23
5,120,040 A 6/1992 Worley
5,502,608 A 3/1996 Senshu et al.
6,106,178 A * 8/2000 Chiu ..... 400/624
6,215,753 B1 * 4/2001 Matsumoto ..... 720/640
6,340,256 B1 * 1/2002 McKay et al. ..... 400/624
6,474,884 B2 * 11/2002 Chiu ..... 400/624

FOREIGN PATENT DOCUMENTS

| | | |
|---|---|---|
| EP | 498561 A2 * | 8/1992 |
| JP | S59-167427 | 9/1984 |
| JP | S60-087482 | 5/1985 |
| JP | H06-064761 | 3/1994 |
| JP | H08-020448 | 1/1996 |
| JP | H09-269586 | 10/1997 |
| JP | 2000-247456 | 9/2000 |
| JP | 2000-289863 | 10/2000 |
| JP | 2001-058727 | 3/2001 |
| JP | 2001-253556 | 9/2001 |
| JP | 2002-068535 | 3/2002 |

* cited by examiner

*Primary Examiner*—Jill E. Culler
(74) *Attorney, Agent, or Firm*—Roylance, Abrams, Berdo & Goodman, L.L.P.

(57) ABSTRACT

A portable media cassette is attached to a printing apparatus. The media cassette includes a loading case for receiving media having an outlet. A pickup device of the printing apparatus can access the media through the outlet. A shutter is installed on the loading case and is movable between a first position for covering the outlet and a second position for opening the outlet.

17 Claims, 14 Drawing Sheets

MEDIA CASSETTE FOR PRINTING APPARATUS

This application claims the benefit under 35 U.S.C. § 119(a) of Korean Patent Application No. 2004-4430, filed on Jan. 20, 2004, Korean Patent Application No. 2004-24025, filed on Apr. 8, 2004, and Korean Patent Application No. 2004-64262, filed on Aug. 16, 2004, in the Korean Intellectual Property Office, the entire disclosures of which are hereby incorporated by reference.

BACKGROUND OF THE INVENTION

1. Field of the Invention

The present invention relates to a media cassette for a printing apparatus. More particularly, the present invention relates to a portable media cassette that is attached to a printing apparatus, on which media discharged from the printing apparatus can be loaded without damaging the media cassette and interrupting the conveying of the media.

2. Description of the Related Art

A portable printing apparatus such as a small size photo-printer has a portable cassette. The portable cassette, on which printable media is placed, is typically detachable from the printing apparatus. The media cassette is manufactured so that the printing media will not escape from the cassette when the cassette is separated from the printing apparatus.

FIG. 1 is a cross-sectional view showing an example of a conventional media cassette. As shown in FIG. 1, media M is placed in a loading case 1, and a cover 4 is coupled to an upper portion of the loading case 1. The cover 4 is divided into a first cover 2 and a second cover 3. The first cover 2 is rotatably coupled to the second cover 3. When the media cassette 10 is separated from the printing apparatus, the second cover 2 is closed so that the media M will not escape from the media cassette 10. As shown in FIG. 2, when the media cassette 10 is mounted on the printing apparatus 20, the second cover 2 rotates to open a front edge portion of the loading case 1. Thus, a pickup roller 5 can access and pick up the media M. However, since the second cover 2 is open when mounted on the printing apparatus 20, the media cassette 10 can be damaged.

Additionally, when the conventional media cassette 10 is mounted in the printing apparatus 20, a back surface of the second cover 2 is exposed outwardly as shown in FIG. 2. A printed medium is then discharged from the media cassette 10. However, the second cover 2 is generally manufactured by a plastic injection molding method. Therefore, the rear surface thereof includes a structure such as a strengthening rib for reinforcement or an ejection pin mark of the mold, thereby degrading the appearance of the media cassette 10. Also, since the printing apparatus 20 has a media conveying path in a 'U' shape, the strengthening rib or the ejection pin mark may interrupt the smooth discharging operation of the printed media.

Accordingly, there is a need for an improved media cassette manufactured so that it will not be damaged when installed into the printing apparatus, is improved aesthetically, and does not interrupt conveying of the media.

SUMMARY OF THE INVENTION

An aspect of the present invention is to provide a portable media cassette on which media discharged from a printing apparatus can be loaded.

Another object of the present invention is to provide a portable media cassette for a printing apparatus, an outlet of which can be opened during a mounting operation of the media cassette without damage.

In accordance with another object of the present invention, a media cassette is provided for a printing apparatus, the media cassette has an improved aesthetic appearance and media conveyance.

The foregoing and other objects and advantages are substantially realized by providing a portable media cassette that is attached to a printing apparatus. The media cassette includes a loading case for receiving media and has an outlet through which a pickup device disposed in the printing apparatus can access the media. A shutter is installed on the loading case and moves between a first position for covering the outlet and a second position for opening the outlet.

The shutter is adapted to slide when contacted with the printing apparatus when the media cassette is mounted in the printing apparatus, and moved to the second position. The media cassette may further include an elastic member for biasing the shutter in the direction of the first position.

The loading case may include a frame for receiving the media and has an opened first surface. An upper cover opens substantially the entire first surface of the frame, except for the outlet by being coupled to the frame. In addition, the shutter may be installed on the upper cover for slidable movement.

The media cassette may further include a first locking unit for locking the shutter in the first and second positions.

The upper cover may be rotatably coupled to the frame, and the upper cover may be rotated to open the first surface of the frame and load the media in the frame.

The media cassette may further include a tray for loading the media discharged from the printing apparatus, the tray is installed on the shutter. The tray may be rotated to a third position wherein the tray is folded on the loading case and a fourth position wherein the tray is inclined with respect to the loading case for loading the media according to the movement of the shutter between the first and second positions. In addition, the media cassette may further include a second locking unit that locks the tray in the third position.

The foregoing and other objects and advantages are also substantially realized by providing a portable media cassette that can be attached to a printing apparatus. The media cassette includes a frame for receiving media and having an opened first surface. An upper cover is slidably coupled to the frame and movable between a first position where the first surface is covered and to a second position where an outlet is formed by opening a part of the first surface so that a pickup device disposed on the printing apparatus can access the media. When the upper cover is located at the second position, the upper cover is upwardly slanted from the front portion of the frame to a rear portion of the frame to load the media discharged from the printing apparatus on the upper cover. A stopper protrudes from the upper edge portion of the upper cover for arranging the discharged media.

The upper cover is preferably adapted to interfere with the printing apparatus and moved to the second position when the media cassette is mounted in the printing apparatus.

The upper cover is rotatable for opening substantially the entire first surface of the frame when the upper cover is located in the second position.

Other objects, advantages, and salient features of the invention will become apparent to those skilled in the art from the following detailed description, which, taken in conjunction with the annexed drawings, discloses the preferred embodiments of the invention.

BRIEF DESCRIPTION OF THE DRAWINGS

The above and other features and advantages of the present invention will become more apparent from the following detailed description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications to the embodiments described herein can be made without departing from the scope and spirit of the invention. Also descriptions of well-known functions or constructions are omitted for conciseness.

Figure 1:
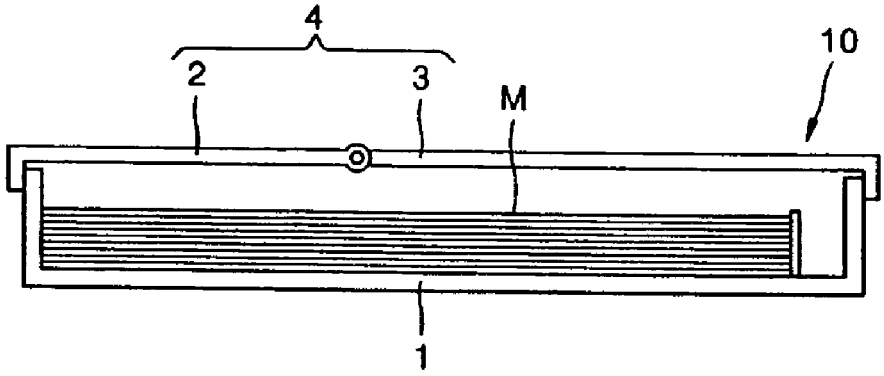
FIG. 1 (PRIOR ART)
FIG. 1 is a cross-sectional view showing a conventional media cassette.
Figure 2:
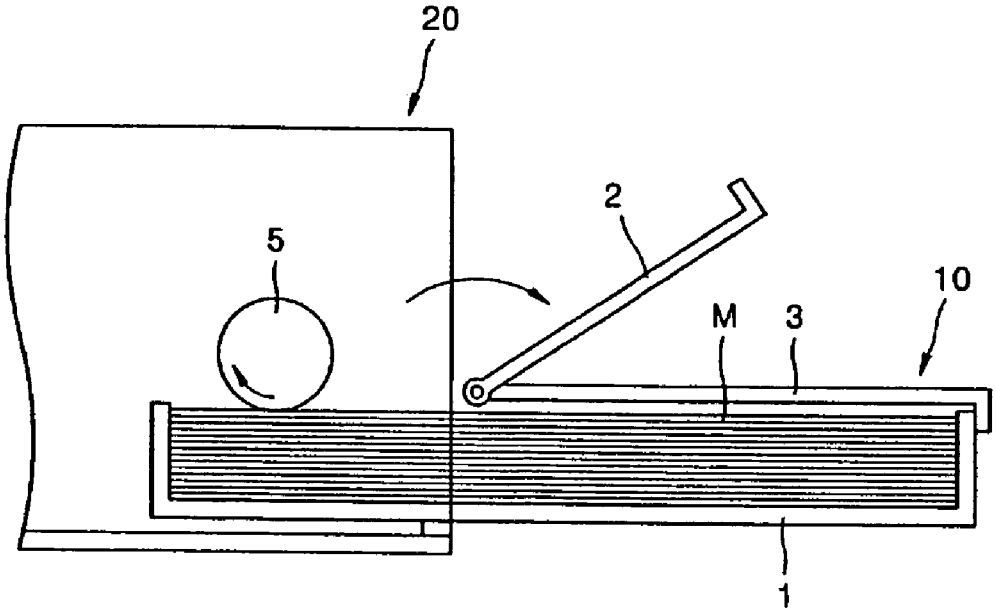
FIG. 2 (PRIOR ART)
FIG. 2 is a cross-sectional view showing a state where a second cover is opened in the conventional media cassette shown in FIG. 1.
Figure 3:
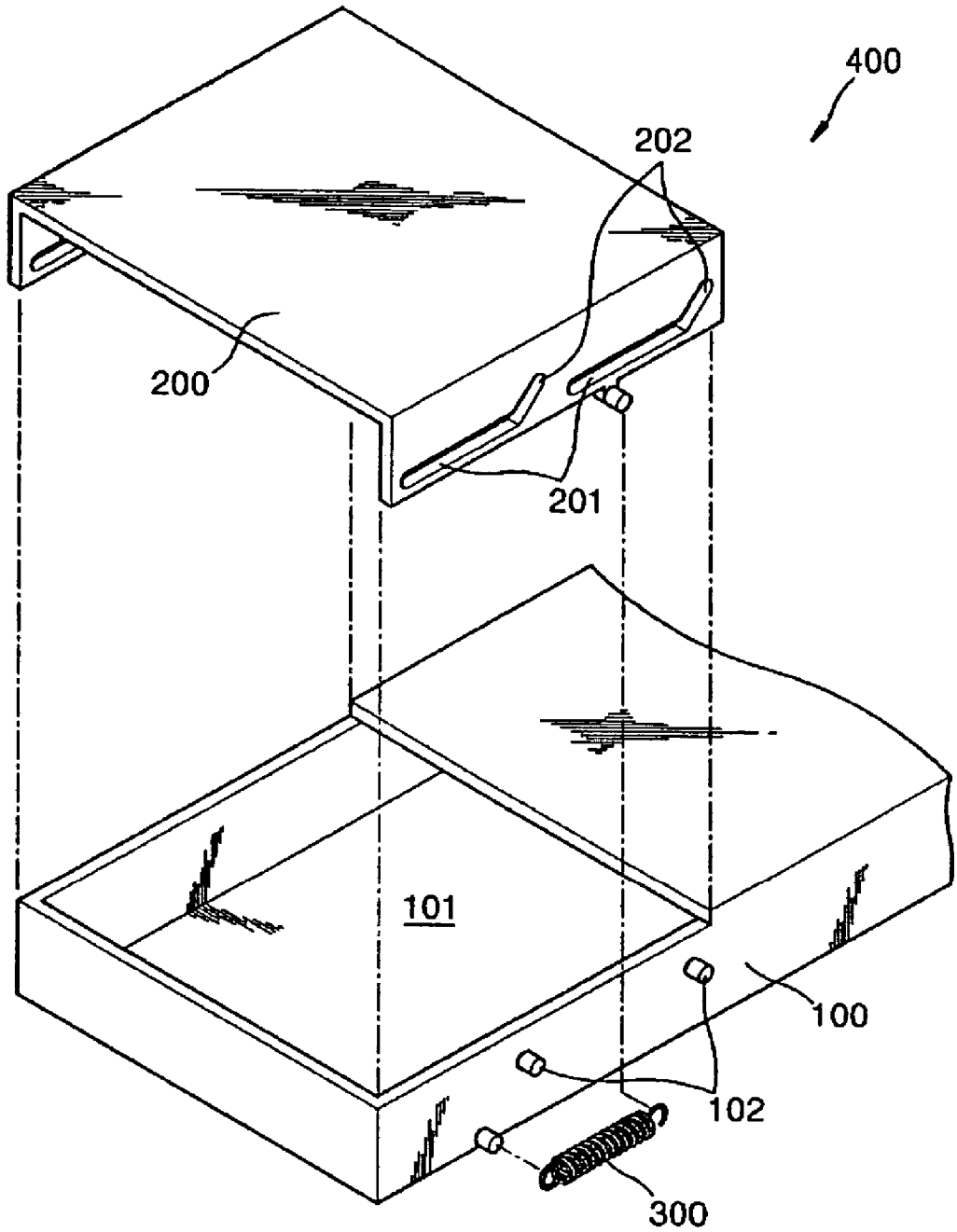
FIG. 3 is an exploded perspective view showing a media cassette according to a first embodiment of the present invention.
Figure 4:
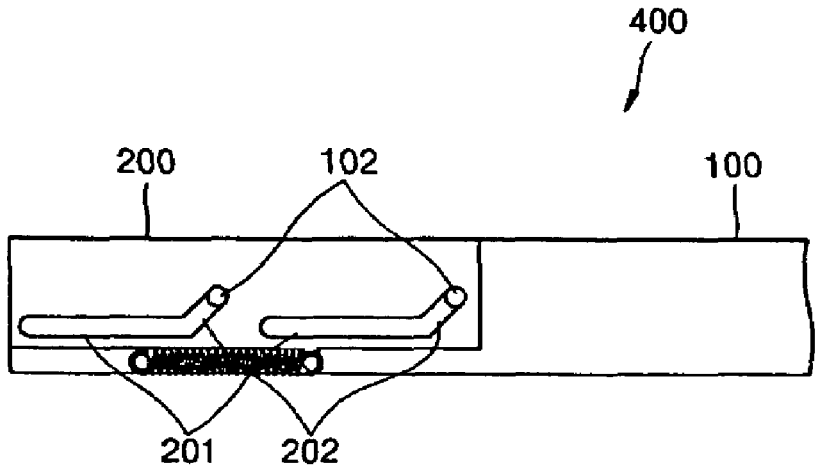
FIG. 4 is a side view showing the media cassette of FIG. 3.

FIG. 3 is an exploded perspective view showing a media cassette according to an exemplary embodiment of the present invention. FIG. 4 is a side view showing the media cassette of FIG. 3. Referring to FIGS. 3 and 4, the media cassette 400 includes a loading case 100 that can receive media. A portion of an upper front edge portion of the loading case 100 is opened for forming an outlet 101 through which a pickup device (reference numeral 5 in FIG. 5) disposed in a printing apparatus (reference numeral 20 in FIG. 5) can access the media. Reference numeral 200 denotes a shutter. The shutter 200 is installed on the loading case 100 for sliding thereon. Therefore, a pair of protrusions 102 disposed on a side portion of the loading case 100, and a pair of slots 201, into which the protrusions 102 can be inserted, are disposed on a side portion of the shutter 200. An end portion 202 of each slot 201 can be slanted.

As shown in FIG. 4, when the media cassette 400 is separated from the printing apparatus 20 for carrying, the shutter 200 is located at a first position where the shutter 200 covers the outlet 101 so that the media received in the loading case 100 does not escape through the outlet 101. In the position where the shutter 200 covers the outlet 101, the shutter 200 is located at the same height as that of the upper surface of the loading case 100.

Figure 5:
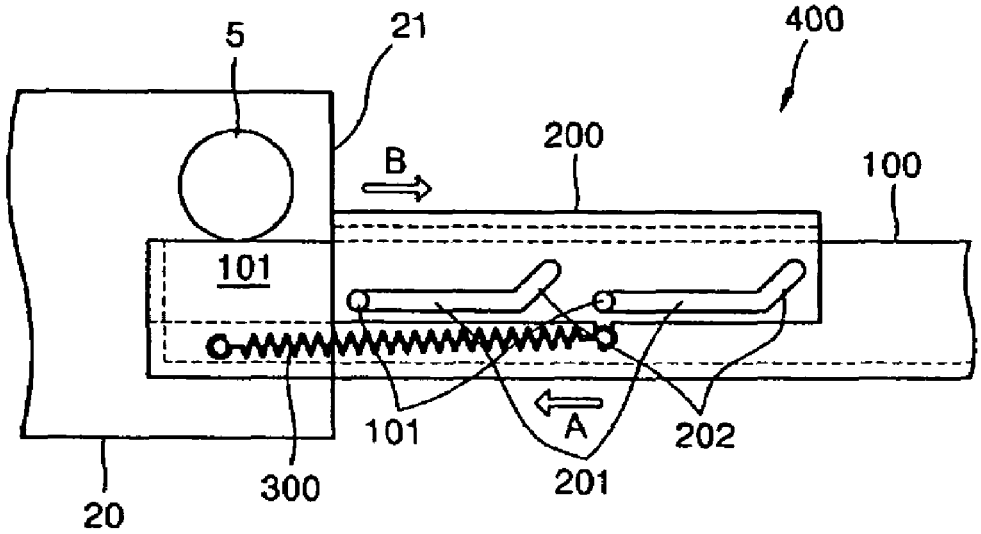
FIG. 5 is a side view illustrating operations of the media cassette of FIG. 3.

FIG. 5 shows a state where the media cassette 400 is mounted in the printing apparatus 20. A user moves the shutter 200 toward a second position where the shutter 200 opens the outlet 101 by pushing the shutter 200 in the direction of, as shown in FIG. 5. After that, the media cassette 400 can be mounted in the printing apparatus 20.

As shown in FIGS. 3 and 4, the media cassette may further include an elastic member 300 that biases the shutter 200 to the closing direction of the outlet 101, that is, to the second position. The elastic member 300 is a tension coil spring, both end portions of which are connected to the shutter 200 and the loading case 100.

As shown FIG. 5, the media cassette 400 is biased towards a position for mounting in the printing apparatus 20. Then, the shutter 200 is pushed by a side portion 21 of the printing apparatus 20, and slid to the B direction. Here, since the end 202 of the slot 201 is slanted, the shutter 200 moves slightly upward and then continues to slide in the B direction again. In a manner that the outlet 101 is opened, the shutter 200 is located on upper portion of the loading case 100. When the media cassette 400 is separated from the printing apparatus 20 by moving the media cassette 400 to B direction, the shutter 200 is moved in the A direction, by the elastic force of the elastic member 300 and covers the outlet 101.

Due to the above structure, the shutter 200 is opened when the media cassette 400 is mounted in the printing apparatus 20. Therefore, damage of the media cassette 400 or the printing apparatus 20 caused when mounting the media cassette 400 into the printing apparatus 20 without opening the second cover as in the conventional media cassette can be prevented.

The media cassette 400 is removed from the printing apparatus 20 by being moved in arrow B direction. Here, if the media cassette 400 does not include the elastic member 300, the user pushes the shutter 200 in the direction of arrow A to cover the outlet 101. If the elastic member 300 is included in the media cassette 400, when the media cassette 400 is removed from the printing apparatus 20, the shutter 200 moves in the direction of arrow A due to the elastic force of the elastic member 300 and covers the outlet 101. Therefore, the user does not need to close the shutter 200.

Also, since the shutter 200 moves while sliding toward the upper portion of the loading case 100, a rear surface of the shutter 200 is not exposed during opening the outlet 101. Thus, an aesthetic appearance of the media cassette 400 can be maintained even when the outlet 101 is opened. In addition, there is no obstacle that interrupts the conveying operation of the medium that is discharged from the printing apparatus 20 on the upper portion of the loading case 100 when the outlet 101 is opened, and thus the discharged medium can be stacked on an upper portion of the media cassette 400.

Hereinafter, the media cassette according to other exemplary embodiments of the present invention will be described as follows. Elements having the same functions as above are denoted by the same reference numerals and detailed descriptions of them will omitted.

Figure 6:
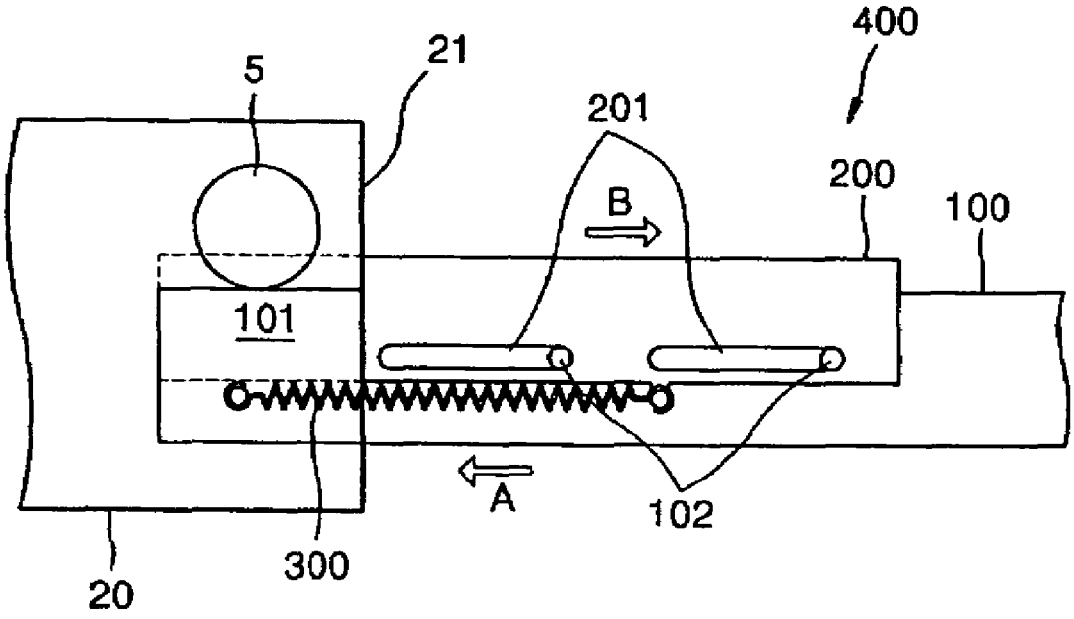
FIG. 6 is a side view showing a media cassette according to a second embodiment of the present invention.

FIG. 6 is a cross-sectional view showing a media cassette according to another aspect of the present invention. The media cassette shown in FIG. 6 is modified from that of FIG. 3. As denoted by a dot line in FIG. 6, the shutter 200 is located higher than the upper surface of the loading case 100 in a state where the outlet 101 is closed. The slots 201 extend parallel to the sliding direction of the shutter 200. Therefore, the shutter 200 is slid only between the A and B directions and moves to the first and second positions.

Figure 7:
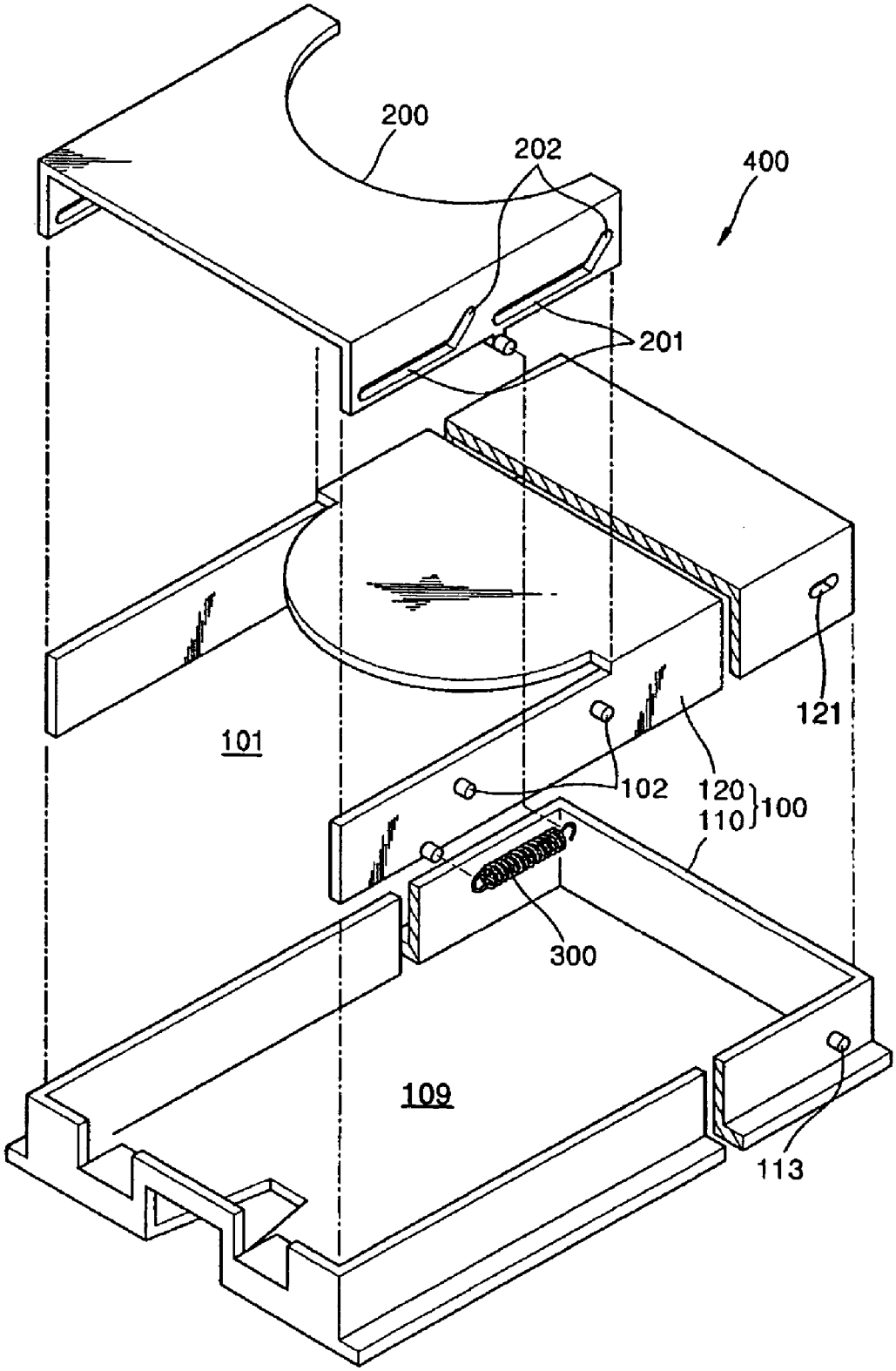
FIG. 7 is an exploded perspective view showing a media cassette according to a third embodiment of the present invention.
Figure 8:
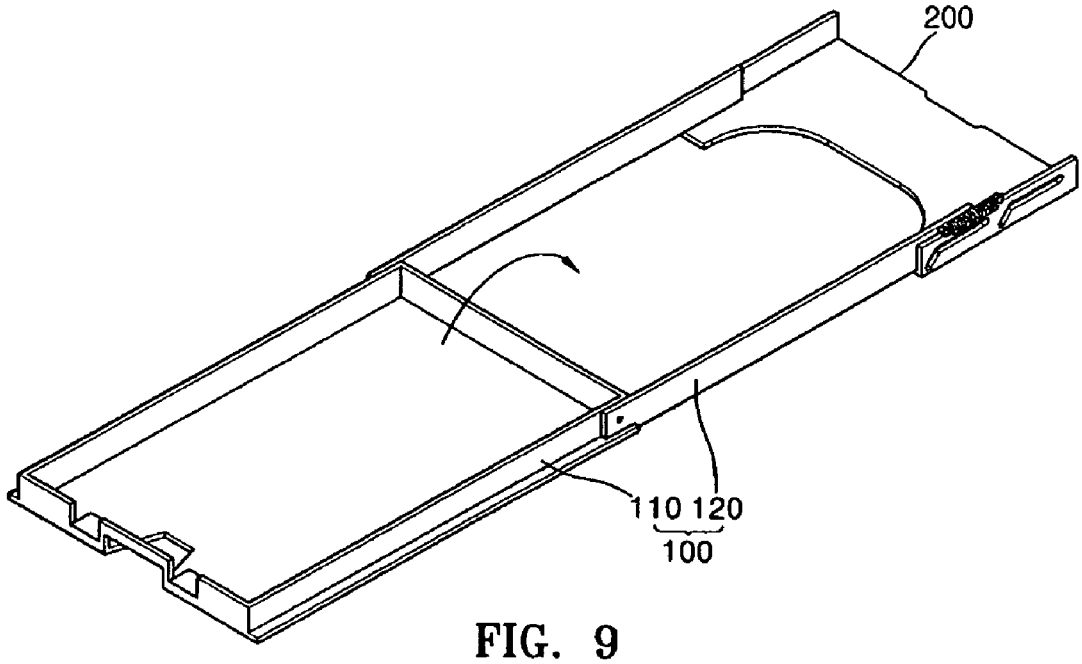
FIG. 8 is a perspective view showing a state where an upper cover of the media cassette is rotated.

FIG. 7 is an exploded perspective view showing a media cassette according to another aspect of the present invention. Referring to FIG. 7, the loading case 100 includes a frame 110 having an open upper portion, and an upper cover 120 that covers the upper portion of the frame 110. When the upper cover 120 is coupled to the frame 110, the outlet 101, through which the pickup device 5 of the printing apparatus 20 can access the media, is formed due to a difference between lengths of the frame 110 and the upper cover 120. A coupling protrusion 113 is formed on a side portion of the frame 110, and a coupling hole 121 coupled to the protrusion 113 is disposed on the upper cover 120. Otherwise, the protrusion 113 may be formed on the upper cover 120, and the coupling hole 121 may be formed on the frame 110. In the media cassette having the above structure, the upper cover 120 is rotated to load the media and open the upper portion of the frame 110 as shown in FIG. 8. Here, it is desirable that the coupling hole 121 is elongated as shown in FIG. 7, in order to avoid the interruption with the frame 110 when the upper cover 120 is rotated.

As shown in FIG. 8, in order to completely open the upper portion of the frame 110 when the upper cover 120 is rotated, preferably the shutter 200 is coupled to the upper cover 120 for rotation with the upper cover 120. The shutter 200 includes a pair of slots 201 that extend in the sliding direction of the shutter 200 and have slanted end portions 202. A pair of protrusions 102 are inserted into the slots 201 and are disposed on the upper cover 120.

Figure 9:
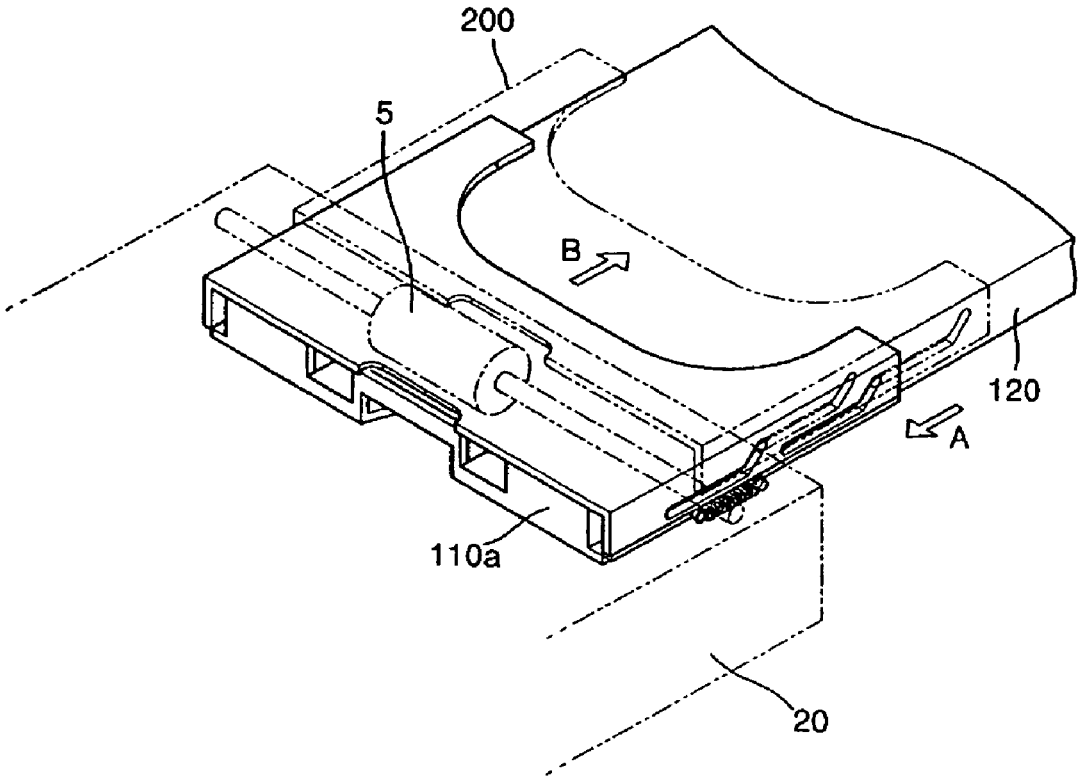
FIG. 9 is a perspective view showing a state where the media cassette according to the third embodiment of the present invention of FIG. 7 is mounted in a printing apparatus.

In the media cassette having the above structure, the upper cover 120 rotates to open the upper portion of the frame 110 and allow the media to be placed in the loading case 100. The user can mount the media cassette 400 in the printing apparatus 20 after pushing the shutter 200 toward the B portion of FIG. 9 to open the outlet 101. In addition, as shown in FIG. 9, when the media cassette 400 is mounted in the printing apparatus 20, the shutter 200 can be opened during the mounting operation. If the elastic member 300 that elastically biases the shutter 200 toward the closing direction of the outlet 101, that is, toward a direction of moving to the first position, is further included in the media cassette 400, when the media cassette 400 is separated from the printing apparatus 20, the shutter 200 covers the outlet 101 by the elastic force of the elastic member 300.

Figure 10:
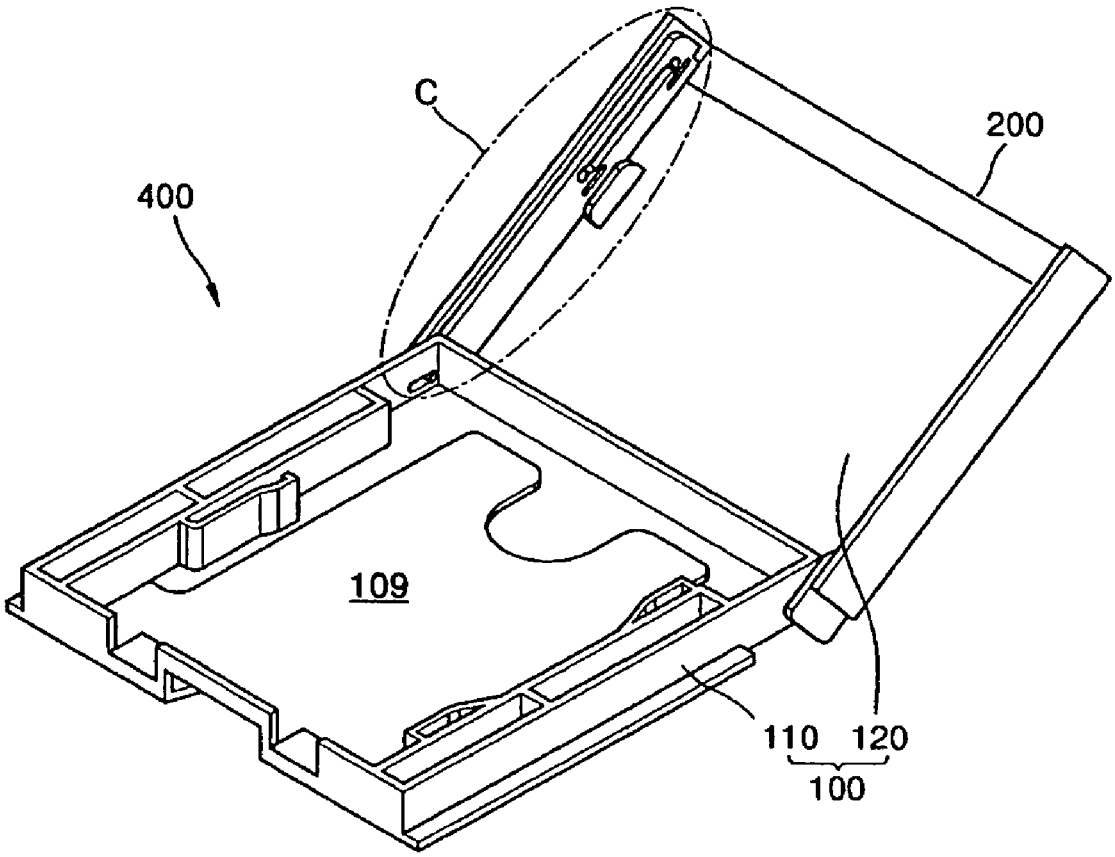
FIG. 10 is a perspective view showing a media cassette according to a fourth embodiment of the present invention.
Figure 11:
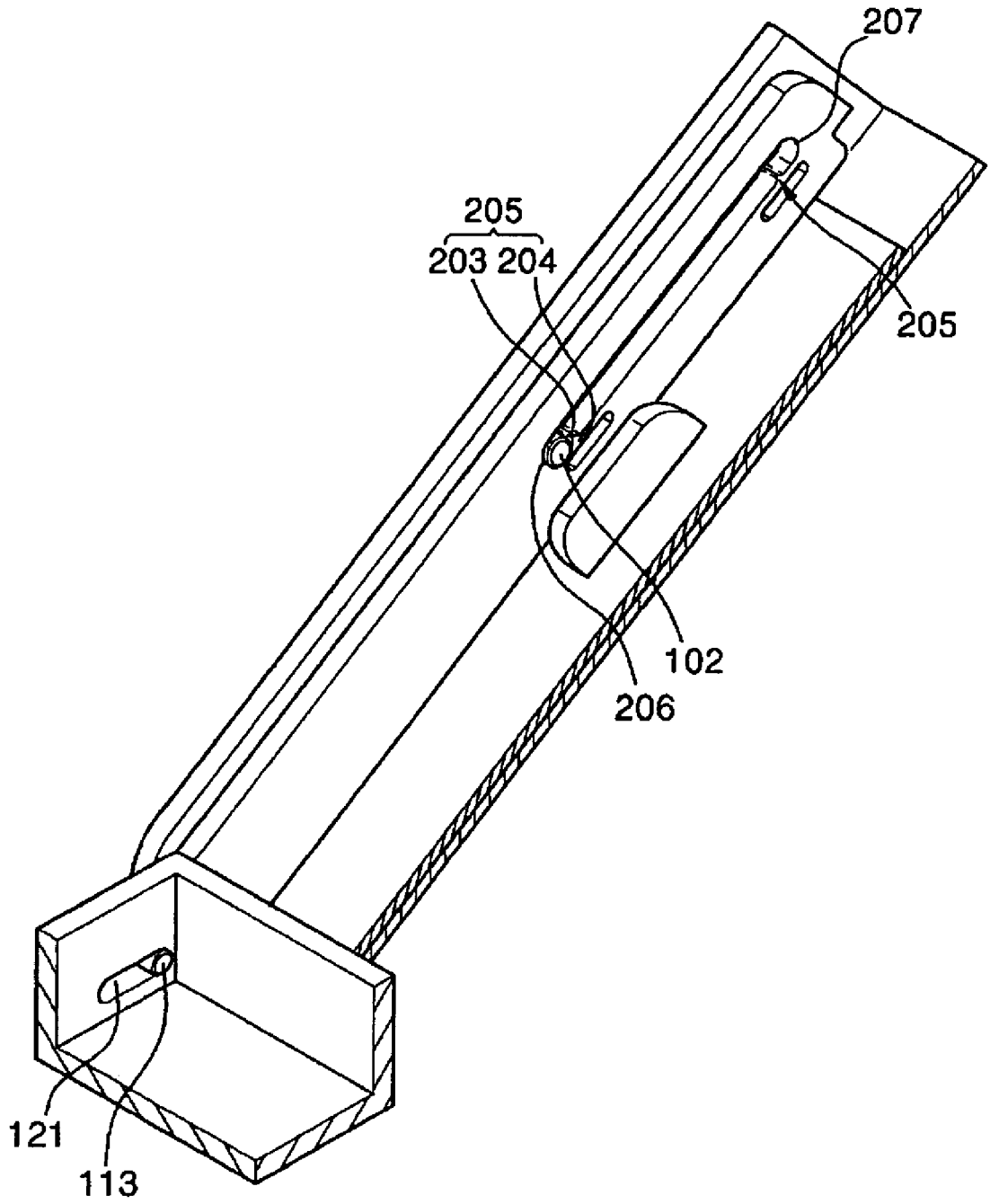
FIG. 11 is a perspective view showing part C of FIG. 10 in detail.
Figure 12:
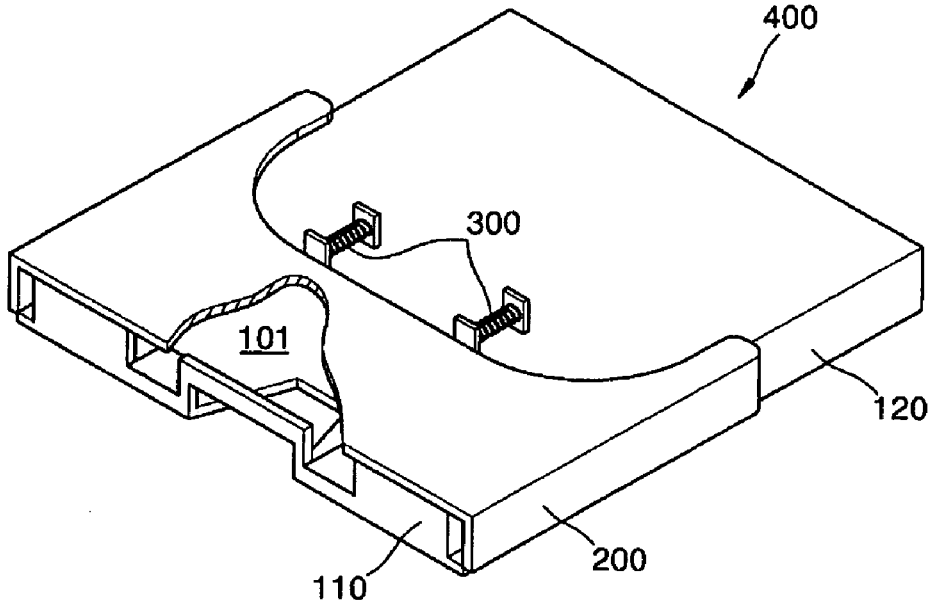
FIG. 12 is a perspective view showing the media cassette according to the fourth embodiment of the present invention.
Figure 13:
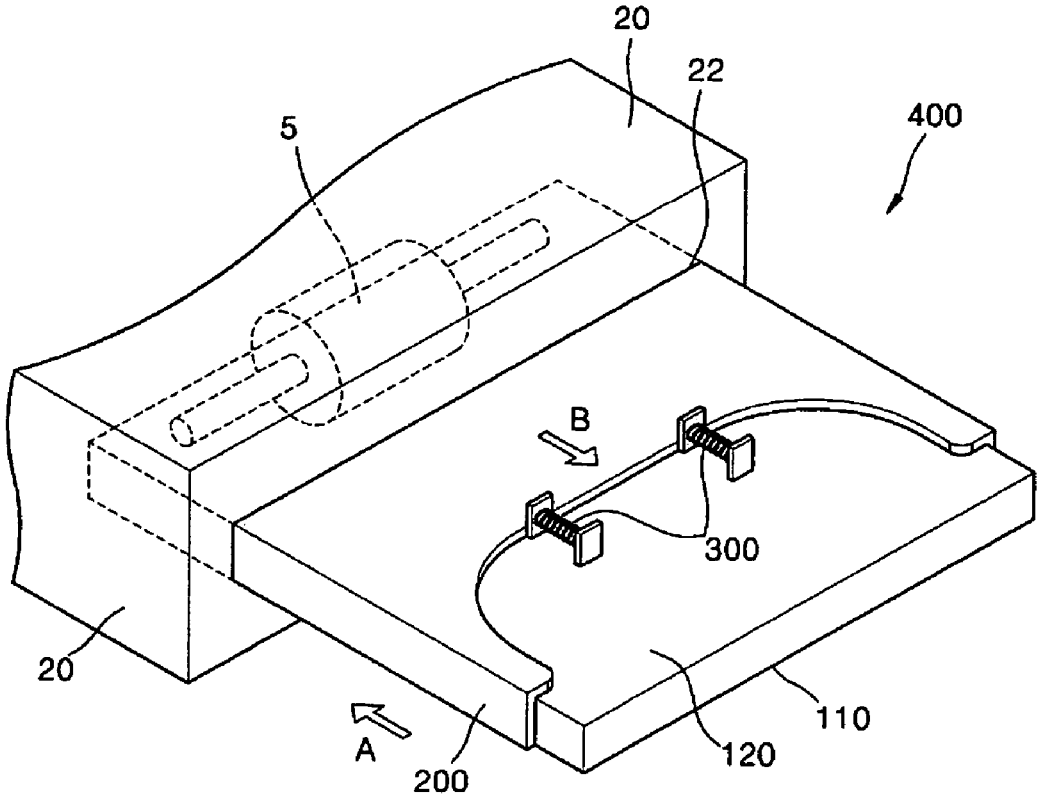
FIG. 13 is a perspective view showing a state where the media cassette shown in FIGS. 10 through 12 according to the fourth embodiment of the present invention is mounted in a printing apparatus.

FIGS. 10 and 12 show a media cassette according to still another embodiment of the present invention, and FIG. 11 is a perspective view illustrating part C of FIG. 10 in detail. FIG. 13 is a perspective view showing a status where the media cassette according to the present embodiment is mounted in the printing apparatus.

Referring to FIGS. 10-13, the upper cover 120 is coupled to the frame 110 and has an opened upper surface (first surface ) 109 for forming the loading case 100. The outlet 101, through which the pickup device 5 of the printing apparatus 20 can access the media, is formed by the difference between lengths of the frame 110 and the upper cover 120. The coupling protrusion 113 is formed on an inner side portion of the upper cover 120, and the coupling hole 121 is disposed on the frame 110. Preferably, the coupling hole 121 is elongated. The shutter 200 is coupled to the upper cover 120, and rotated with the upper cover 120. The shutter 200 of the present embodiment is located at upper portion of the upper cover 120 when the shutter 200 covers the outlet 101. A pair of slots 201 extend towards the sliding direction of the shutter 200 and are disposed on the side portion of the shutter 200. A pair of protrusions 102, which are inserted into the slots 201, are disposed on the upper cover 120. The media cassette 400 may further include the elastic member 300 that biases the shutter 200 toward the closing direction of the outlet 101. The elastic member 300 of the present embodiment is preferably a compression coil spring.

The media cassette 400 further includes a first locking unit 205 that locks the shutter 200 when the shutter 200 covers the outlet 101 or opens the outlet 101. Referring to FIG. 11, an example of the first locking unit 205 is disclosed. Projections 203 are disposed on both ends 206, 207 of the slot 201, and the projection 203 is formed on an arm 204 that is elastically deformable.

The user pushes the shutter 200 toward the B direction for opening the outlet 101, and then can mount the media cassette 400 in the printing apparatus 20. Here, the shutter 200 is locked by the first locking unit 205 when the outlet 101 is opened. Also, after removing the media cassette from the printing apparatus 20, the user pushes the shutter 200 in a direction of the A arrow A to close the outlet 101. Here, the shutter 200 is locked by the first locking unit 205 in the state that the shutter 200 covers the outlet 101.

When the media cassette 400 is mounted in the printing apparatus 20, the shutter 200 may be opened by the mounting operation of the media cassette 400. When the media cassette 400 is pushed in a direction of arrow A in order to be mounted in the printing apparatus 20, the shutter 200 is pushed by a front portion 22 of the printing apparatus 20 and opens the outlet 101. When the mounting operation of the media cassette 400 is completed, the protrusion 102 pushes the projection 203, and the arm 204 is elastically retrieved. Consequently, the protrusion 102 reaches the end 206 of the slot 201. The projection 203 then blocks the protrusion 102 while the arm 204 returns to the original position. The shutter 200 is locked in the state of opening the outlet 101. When the media cassette 400 is separated from the printing apparatus 20, the shutter 200 moves in a direction of the B arrow B by the elastic force of the elastic member 300, and slides to the other end 207 of the slot 201. When the protrusion 102 reaches the other end 207 of the slot 201, the shutter 200 is locked by the first locking unit 205.

Figure 14:
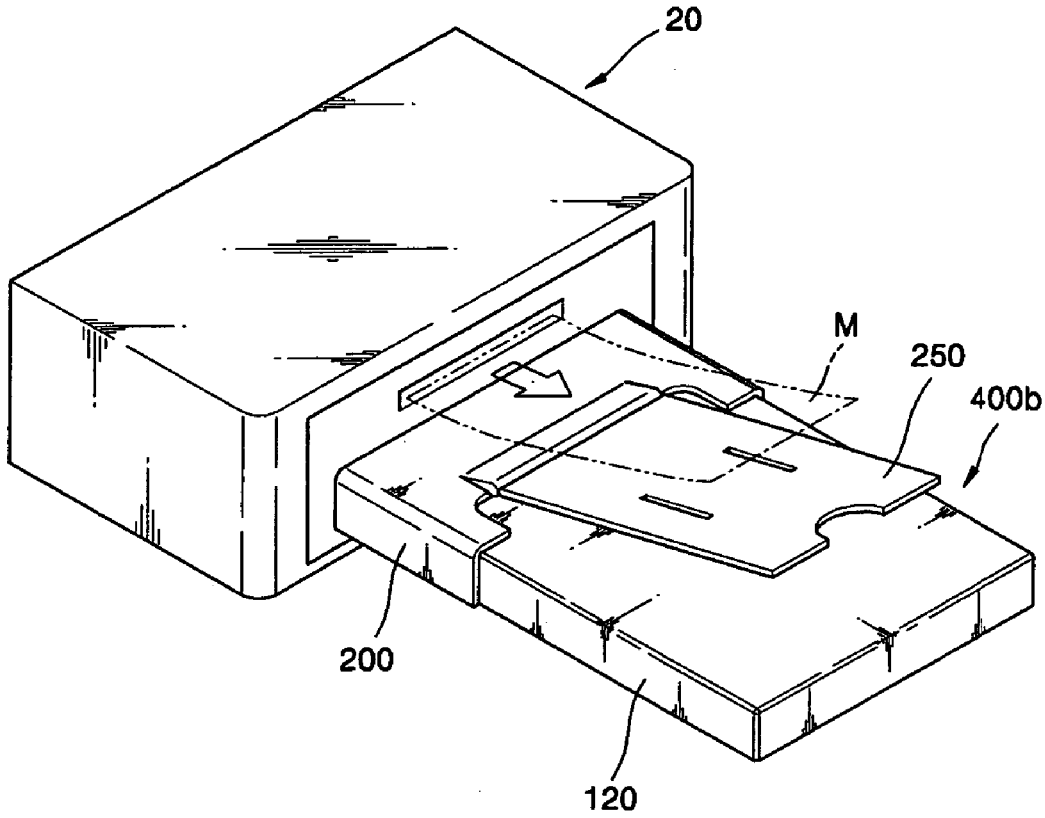
FIG. 14 is a perspective view showing a media cassette according to a fifth embodiment of the present invention mounted in a printing apparatus.
Figure 15:
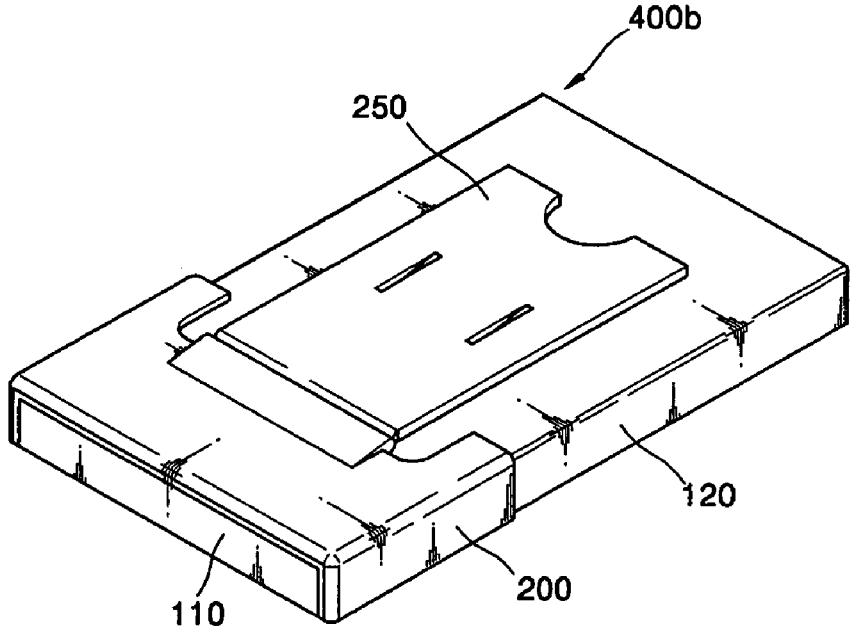
FIG. 15 is a perspective view showing the media cassette according to the fifth embodiment of the present invention separated from the printing apparatus.

FIGS. 14 and 15 are perspective views showing a media cassette according to another aspect of the present invention.

Referring to FIG. 14, a media cassette 400*b* of the present embodiment further includes a tray 250 for loading the media M discharged from the printing apparatus 20. Preferably, tray 250 is upwardly inclined in a discharging direction of the media M so that the media M is not deviated from the media cassette 400*b*. When the media cassette 400*b* is separated from the printing apparatus 20 for portability, the tray 250 is located at a third position, that is, folded on the upper cover 120 as shown in FIG. 15. In addition, when the media cassette 400*b* is mounted in the printing apparatus 20, it preferable that the tray 250 is located at a fourth position, that is, upwardly inclined in the discharge direction of the media M. Thus, the tray 250 of the present embodiment is rotatably installed on the shutter 200, and rotates toward the third and fourth positions when the shutter 200 moves between the first and second positions. According to the above structure, portability of the media cassette 400*b* can be improved, and it is convenient to use the media cassette 400*b* since there is no need to move the tray 250 toward the fourth position by the user.

Figure 16:
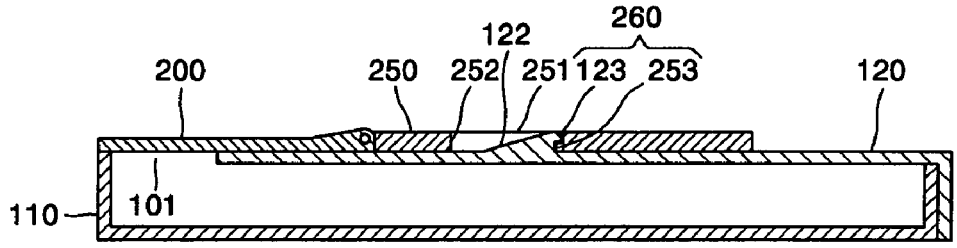
FIGS. 16 and 17 are cross-sectional views showing operations of the media cassette according to the fifth embodiment of the present invention.
Figure 17:
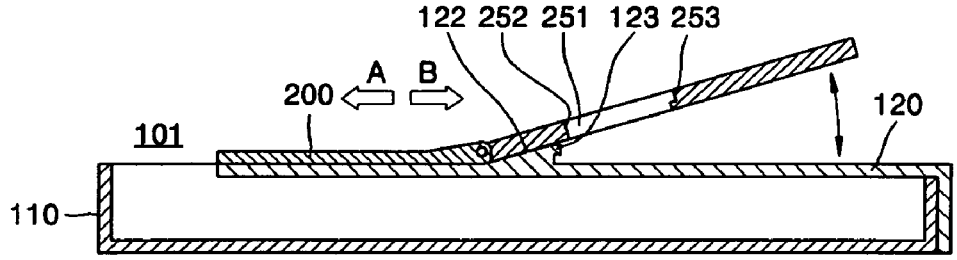

Referring to FIG. 16, a slot 251 is formed on the tray 250 in a longitudinal direction of the tray 250. A slant rib 122 is upwardly inclined in a direction of conveying media M and is disposed on the upper cover 120. When the shutter 200 is located at the first position, the slant rib 121 is inserted into the slot 251, thus the tray 250 is located at the third position by being folded on the upper cover 120. A second locking unit 260 locks the tray 250 in the third position. The second locking unit 260 includes a concave portion 123 disposed on one end of the slant rib 122 and a protruded portion 253 disposed on the slot 251. As shown in FIG. 16, when the tray 250 is located at the third position, the protruded portion 253 is inserted in the concave portion 123, thus the tray 250 is not rotated. As shown in FIG. 17, when the shutter 200 is moved to a direction denoted by arrow A, in order to open the outlet 101, the protruded portion 253 gets out of the concave portion 123 to release the locking of the tray 250. When an end portion 252 of the slot 251 contacts the slant rib 122, the tray 250 is rotated, and the shutter 200 is located at the second position, the tray 250 is located at the fourth position, that is, upwardly inclined in the direction of conveying the media M. If the shutter 200 is moved along the arrow B in FIG. 17, in order to close the outlet 101, the tray 250 is reversely rotated toward the third position. In addition, when the shutter 200 returns to the first position, the protruded portion 253 is inserted into the concave portion 123, and the tray 250 is locked at the third position.

Figure 18:
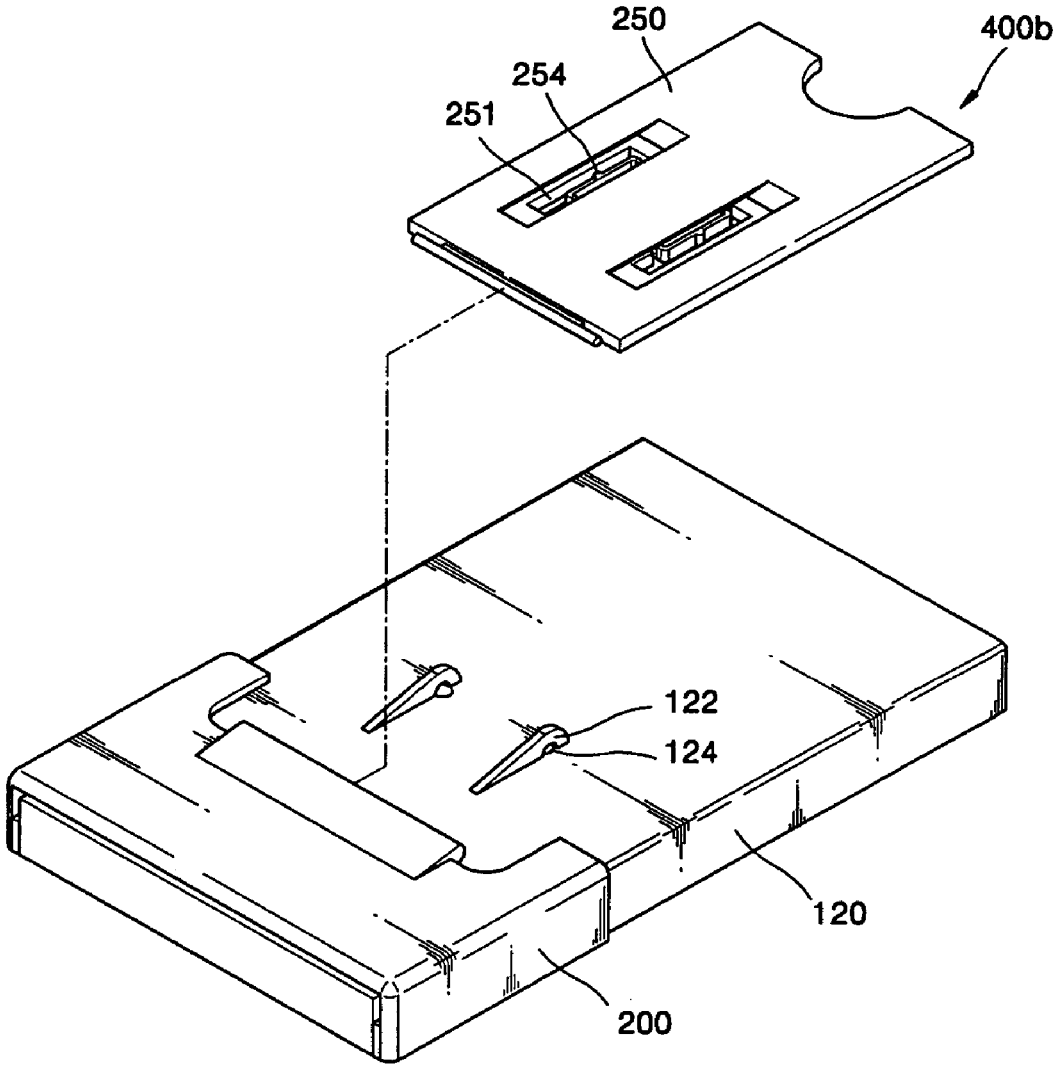
FIG. 18 is an exploded perspective view showing a modified example of a second locking unit.

As shown in FIG. 18, an elastic slice 254 is disposed on slot 251, and a coupling recess 124, to which the elastic slice 254 is coupled, can be disposed on the slant rib 122, as a modified example of the second locking unit 260. In the above structure, when the tray 250 is located at the third position, the elastic slice 254 is coupled to the coupling recess 124 to lock the tray 250. When the shutter 200 is moved to the second position, the elastic slice 254 falls out of the coupling recess 124, and the tray 250 is rotated toward the fourth position.

The tray 250 and the second locking unit 260 can be applied to the media cassettes shown in FIGS. 3 through 6. In this case, the slant rib 122 can be disposed on the upper surface of the loading case 100.

Figure 19:
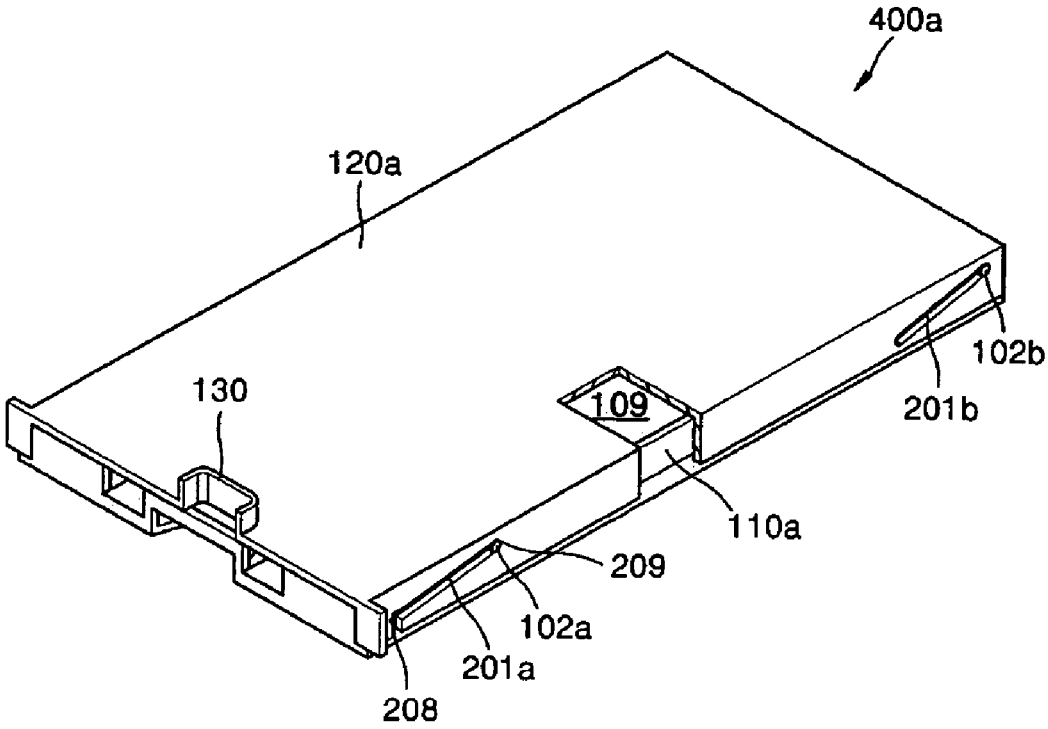
FIGS. 19 and 20 are perspective views showing a media cassette according to a sixth embodiment of the present invention.
Figure 20:
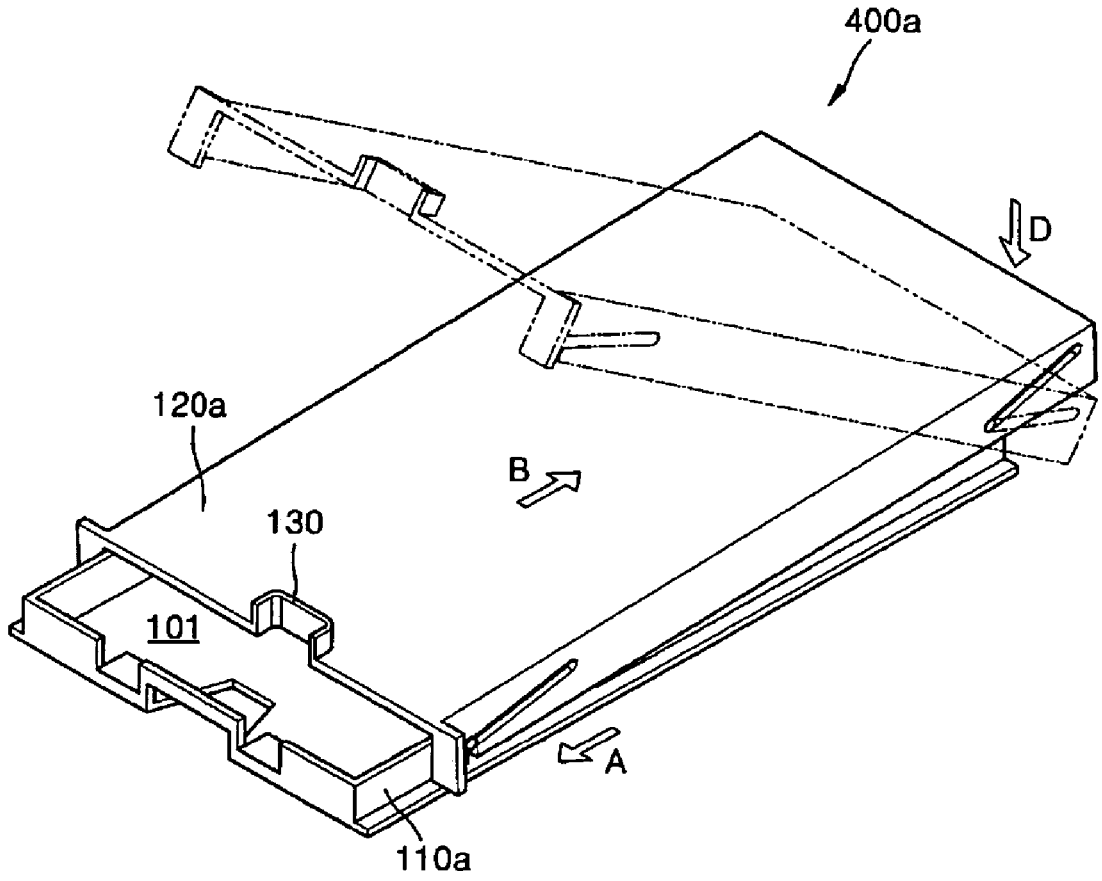

FIGS. 19 and 20 are perspective views showing a media cassette according to another embodiment of the present invention. Referring to FIGS. 19 and 20, a frame 110*a* having an opened upper portion (first surface) 109 and an upper cover 120*a* covering the upper portion 109 of the frame 110*a* are disclosed. The upper cover 120*a* can be coupled to the frame 110*a* and slide thereon, and move between the first position where the upper portion 109 of the frame 110*a* is covered and the second position where the outlet 101 is formed by opening a part of the upper portion 109 of the frame 110*a* so that the pickup device (reference numeral 5 in FIG. 5) is disposed on the printing apparatus (20 in FIG. 5). A first slot 201*a* and a second slot 201*b* are disposed on a front edge and a rear end of the upper cover 120*a*, respectively. The first and second slots 201*a*, 201*b* are formed to be upwardly slanted from the front portion 208 to the rear portion 209. A first protrusion 102*a* and a second protrusion 102*b* are respectively inserted into the first and second slots 201*a*, 201*b*, and are disposed on the side portion of the frame 110.

According to the above structure, the user can mount the media cassette 400*a* in the printing apparatus (not shown) after opening the upper end portion of the frame 110*a* by pushing the upper covers 200*a* in the direction of arrow B.

Also, when the media cassette 400*a* is pushed in the direction of arrow A to be mounted in the printing apparatus (not shown), the upper cover 120*a* may slide toward the B direction by the interference with the printing apparatus. Here, the upper cover 120*a* is slid while inclined, as shown in FIG. 20. When the media cassette 400*a* is completely mounted in the printing apparatus, the outlet 101, through which the pickup device (5 in FIG. 5) of the printing apparatus (20 in FIG. 5) can access the media, is formed.

A stopper 130 is disposed on a front portion of the upper cover 120*a*. The printing apparatus can discharge the printed medium onto the media cassette 400*a*. Here, the discharged medium is stacked on the upper cover 120*a*. The stopper 130 protrudes from the upper cover 120*a*. The discharged medium slides toward the printing apparatus along the slanted upper cover 120*a*, and is stopped and arranged by the stopper 130. Thus, the discharged medium does not enter the printing apparatus again.

The front edge portion 208 of the first slot 201*a* is open. When the upper cover 120*a* is pushed toward the B portion, the first and second protrusions 102*a*, 102*b* are located at the front edge portions 208 of the first and second slots 201*a* and 201*b*, respectively. In that status, a rear end portion of the upper cover 120*a* is pushed in the direction of arrow D of FIG. 20, then the first protrusion 102*a* escapes from the first slot 201*a* through the front portion 208 of the open first slot 201*a*, and the upper cover 120*a* is rotated as shown by the dot line of FIG. 20 while centering around the second protrusion 102*b*. According to the above operation, the upper cover 120*a* is rotated to open the upper portion of the frame 110*a* and allow the media to be placed.

According to the media cassette for the printing apparatus of exemplary embodiments of the present invention, the outlet is opened by the mounting operation of the media cassette when the media cassette is mounted in the printing apparatus, thus the user can use the media cassette more conveniently.

Since the elastic member is further included in the media cassette, the outlet can be closed automatically by the elastic force when the media cassette is removed from the printing apparatus.

In addition, the rear surface of the shutter is not exposed during opening/closing the outlet, an aesthetic appearance of the media cassette can be maintained.

Also, the printed media can be stacked on the media cassette.

The tray that is moved to the position for being portable and the position for loading the media with the moving operation of the shutter is further included, therefore the convenience of the user can be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A portable media cassette that is attachable to a printing apparatus, the media cassette comprising:

a loading case to receive media, the loading case having an outlet, through which a pickup device disposed in the printing apparatus can access the media;

a shutter installed on the loading case, the shutter being movable between a first position to cover the outlet and a second position for opening the outlet; and a first locking unit to lock the shutter in at least one of the first and second positions.

2. The media cassette of claim 1, wherein the shutter is adapted to slide by contacting the printing apparatus.

3. The media cassette of claim 2, further comprising:

an elastic member to bias the shutter in the direction of the second position.

4. The media cassette of claim 1, further comprising:

a tray to load the media discharged from the printing apparatus, the tray being installed on the shutter.

5. The media cassette of claim 4, wherein the tray is rotated to a first position wherein the tray is folded on the loading case, and a second position wherein the tray is inclined with respect to the loading case to load the media in accordance with moving the shutter between the first and second positions.

6. The media cassette of claim 5, further comprising a second locking unit to lock the tray in the first position.

7. The media cassette of claim 1, wherein the loading case includes:

a frame to receive the media having an opened first surface; and an upper cover to cover the first surface of the frame except the outlet is coupled to the frame, wherein the shutter is installed for slidable movement on the upper cover.

8. The media cassette of claim 7, further comprising:

a slot extending in the sliding direction of the shutter and disposed on one of the shutter and the upper cover, and a protrusion adapted for insertion into the slot is disposed on the other one of the shutter and the upper cover.

9. The media cassette of claim 8, wherein an end portion of the slot is slanted, and the shutter being located at the same height as the upper cover at the first position, and slidable over the upper cover for being moved to the second position.

10. The media cassette of claim 8, wherein the shutter is located at higher position than the upper cover, and the slot is formed substantially parallel to the sliding direction of the shutter.

11. The media cassette of claim 7, wherein the upper cover is rotatably coupled to the frame to open the first surface of the frame and loading the media in the frame.

12. The media cassette of claim 7, further comprising a tray on which the media discharged from the printing apparatus is loaded and installed on the shutter.

13. The media cassette of claim 12, wherein the tray is rotated to a first position wherein the tray is folded on the loading case and a second position wherein the tray is inclined with respect to the loading case to load the media in accordance with moving the shutter between the first and second positions.

14. The media cassette of claim 13, further comprising a second locking unit that locks the tray in the first position.

15. The media cassette of claim 1, wherein the shutter is located higher in the second position than in the first position with respect to the loading case.

16. A portable media cassette that is attachable to a printing apparatus, the media cassette comprising:

a frame to receive media and having an opened first surface;

an upper cover coupled to the frame for slidable movement between a first position wherein the first surface is covered and a second position wherein an outlet is formed by opening a part of the first surface, so that a pickup device disposed on the printing apparatus can access the media; and first and second slots are upwardly slanted and are disposed on front and rear edges of the frame and the upper cover, and first and second protrusions are inserted into the first and second slots, respectively, and an end portion of the first slot is open for rotation about the second protrusion when the upper cover is located at the second position;

wherein when the upper cover is located at the second position, the upper cover is upwardly slanted from the front portion of the frame to a rear portion of the frame for loading the media discharged from the printing apparatus on the upper cover, and a stopper protrudes from the upper edge portion of the upper cover for arranging the discharged media; and wherein when the upper cover is rotated to open substantially the entire first surface of the frame when the upper cover is located at the second position.

17. The media cassette of claim 16, wherein the upper cover interferes with the printing apparatus and moves to the second position when the media cassette is mounted in the printing apparatus.

* * * * *